US006385413B2

(12) United States Patent
Sasaki et al.

(10) Patent No.: US 6,385,413 B2
(45) Date of Patent: May 7, 2002

(54) DEVELOPING DEVICE TO WHICH DEVELOPING VOLTAGE IS APPLIED FROM NON-DRIVING SIDE

(75) Inventors: Teruhiko Sasaki; Yoshikazu Sasago; Shinya Noda; Yoshiyuki Batori; Takashi Akutsu, all of Toride; Ichiro Terada, Abiko, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/781,220

(22) Filed: Feb. 13, 2001

(30) Foreign Application Priority Data

Feb. 16, 2000 (JP) ..... 2000-037700

(51) Int. Cl.[7] ..... G03G 15/06; G03G 15/00
(52) U.S. Cl. ..... 399/90; 399/111
(58) Field of Search ..... 399/90, 270, 111, 399/119, 88

(56) References Cited

U.S. PATENT DOCUMENTS 6,275,668 B1 * 8/2001 Batori ..... 399/90

FOREIGN PATENT DOCUMENTS

JP 2000-10387 * 1/2001

* cited by examiner

*Primary Examiner*—Joan Pendegrass
(74) *Attorney, Agent, or Firm*—Fitzpatrick, Cella, Harper & Scinto

(57) ABSTRACT

A developing device is detachably attachable to an image forming apparatus, which has a developer carrying member, a developer regulating member, a conductive support member, and a driving gear. A first electrode member is provided at a driving side of the developer carrying member. A developing voltage is applied to the first electrode, and which electrically communicates with the conductive support member. A second electrode member electrically communicates between the conductive support member and a nondriving side of the developer carrying member.

6 Claims, 10 Drawing Sheets

DEVELOPING DEVICE TO WHICH DEVELOPING VOLTAGE IS APPLIED FROM NON-DRIVING SIDE

BACKGROUND OF THE INVENTION

1. Field of the Invention

The present invention relates to a developing device adapted to develop an electrostatic latent image formed on an image bearing member and used with an image forming apparatus of electrophotographic type or electrostatic recording type such as a copying machine, a printer and the like, and more particularly, it relates to a developing device preferably used with a process cartridge.

2. Related Background Art

An example of an arrangement for applying bias to a developing roller of a developing apparatus is shown in FIG. 9.

There has been proposed a method in which a flange member F formed from a conductive member is provided at an end of a, developing roller D, and an electrode comprised of a compression coil spring Sp is electrically connected to the flange member F, and one end of the compression coil spring Sp is attached to a housing of the developing apparatus and the spring is slidingly contacted with contact member C which is electrically communicated with a power feeding member V provided in a main body of apparatus when the developing apparatus is mounted to a frame of apparatus.

Further, as another method for applying the bias to the developing roller D as developing means, there has been proposed a method in which, as shown in FIG. 10, an elastic abutment portion Cs is provided on a contact member C, and application of bias is effected by abutting the elastic abutment portion Cs against a flange member F formed from conductive member provided at an end of the developing roller D.

In the above-mentioned method, since the compression spring Sp or the flange member F is rotated integrally with the developing roller D to slidingly contact with the contact member C, generally, conductive grease is coated on a sliding portion Cp.

However, when the power feeding member V for feeding power from the electrode member provided at a driving side of the main body of the image forming apparatus to the flange member F at a driving side of the developing roller D is provided, since there are gears G as driving means for driving the developing roller D, an installation position of the power feeding member V is limited, thereby making compactness of the developing apparatus difficult.

SUMMARY OF THE INVENTION

An object of the present invention is to provide a compact developing device.

Another object of the present invention is to provide a developing device in which power can be fed from a nondriving side to a developing roller.

A further object of the present invention is to provide a developing device detachably attachable to an image forming apparatus, comprising a developer carrying member for carrying developer, a developer regulating member for regulating an amount of the developer on the developer carrying member, a conductive support member for supporting the developer regulating member, a driving gear provided on the developer carrying member and adapted to receive a driving force from a main body of the image forming apparatus, a first electrode member which is provided at a driving side of the developer carrying member and to which developing voltage is applied and which is electrically communicated with the conductive support member, and a second electrode member for electrically communicating between the conductive support member and a non-driving side of the developer carrying member.

The other objects and features of the present invention will be apparent from the following detailed explanation referring to the accompanying drawings.

DESCRIPTION OF THE PREFERRED EMBODIMENTS

The present invention will not be fully explained in connection with embodiments thereof with reference to the accompanying drawings.

Figure 6:
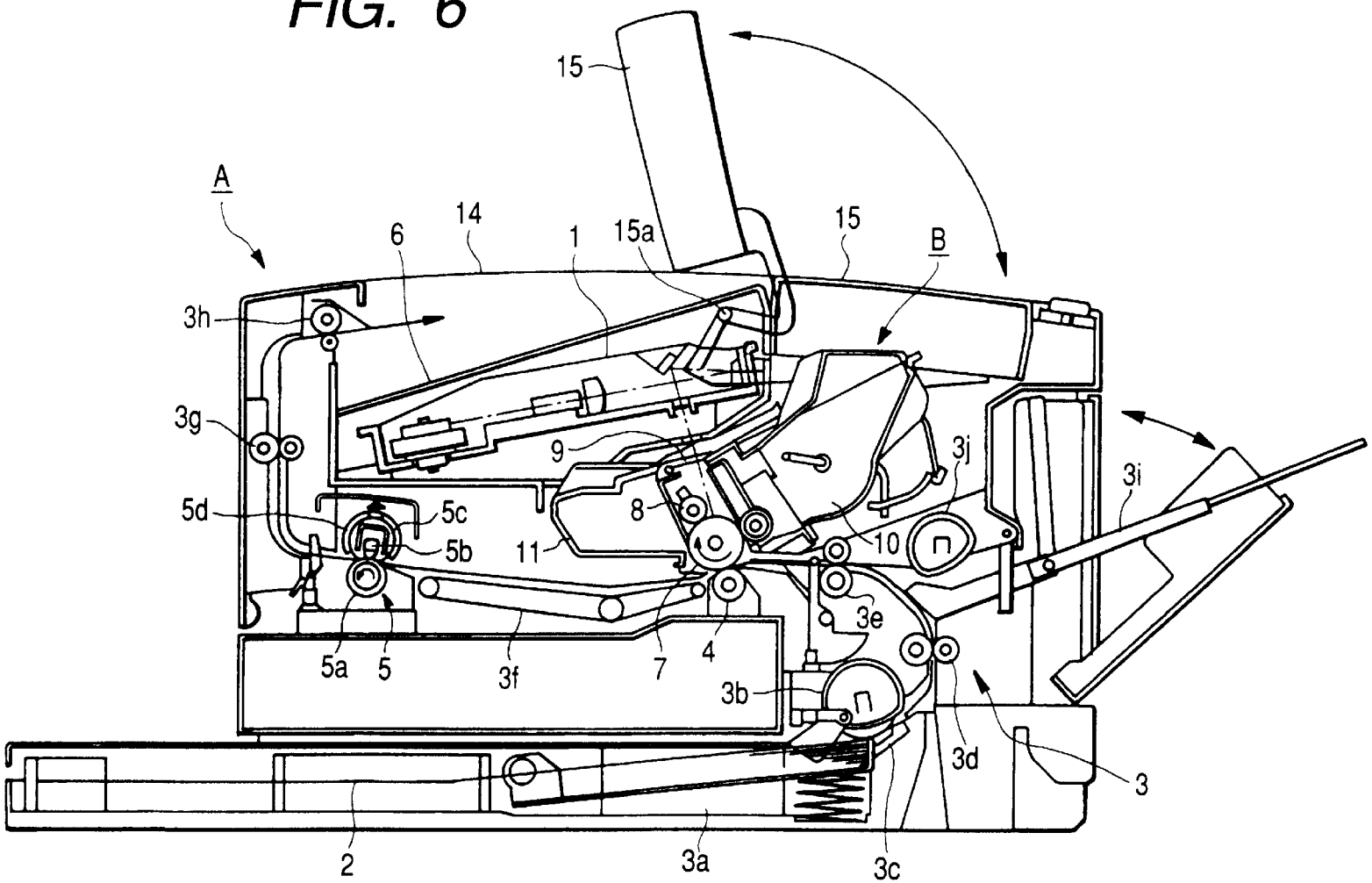
FIG. 6 is a sectional view of an electrophotographic image forming apparatus (laser beam printer) having a process cartridge according to the present invention.

FIG. 6 is a sectional view of an electrophotographic image forming apparatus (laser beam printer) A. In the electrophotographic image forming apparatus A, information light corresponding to image information from an optical system 1 is illuminated onto a drum-shaped electrophotographic photosensitive member (referred to as "photosensitive drum" hereinafter) 7, thereby forming an electrostatic latent image on the photosensitive drum 7. The electrostatic latent image is developed with toner as developer to be visualized as a toner image.

Further, in synchronism with the formation of the toner image, a recording media P such as recording sheets, OHP sheets or the like from a cassette 3*a* are separated one by one by means of a pick-up roller 3*b* and an urging member 3*c* urged against the pick-up roller, and the separated recording medium is conveyed by conveying means 3 comprised of a conveying roller pair 3*d* and a registration roller pair 3*e*. The toner image formed on the photosensitive drum 7 constituted as a cartridge unit as a process cartridge B is transferred onto the recording medium 2 by applying voltage to a transfer roller 4 as transferring means, and the recording medium 2 to which the toner image was transferred is conveyed to a fixing apparatus 5 by a conveying belt 3*f*. The fixing apparatus 5 comprises a driving roller 5*a*, and a fixing rotary member 5*d* comprised of a tubular sheet rotatably supported by a support 5*c* and including a heater 5*b* therewithin and serves to fix the toner image onto the recording medium 2 by applying heat and pressure to the recording medium 2 passing through the fixing apparatus. The recording medium 2 to which the toner image was fixed is conveyed by discharge roller pairs 3*g*, 3*h* and is discharged onto a discharge portion 6 through a reverse rotation conveying path. Incidentally, in the image forming apparatus A, a recording medium can be supplied by a manual insertion tray 3*i* and a roller 3*j*.

On the other hand, the process cartridge B includes the photosensitive drum 7 and at least one process means. The process means may include a charging roller 8 for charging the photosensitive drum 7, a developing apparatus 10 for developing the electrostatic latent image formed on the photosensitive drum 7, and a cleaning apparatus 11 for cleaning toner remaining on the surface of the photosensitive drum 7.

Figure 7:
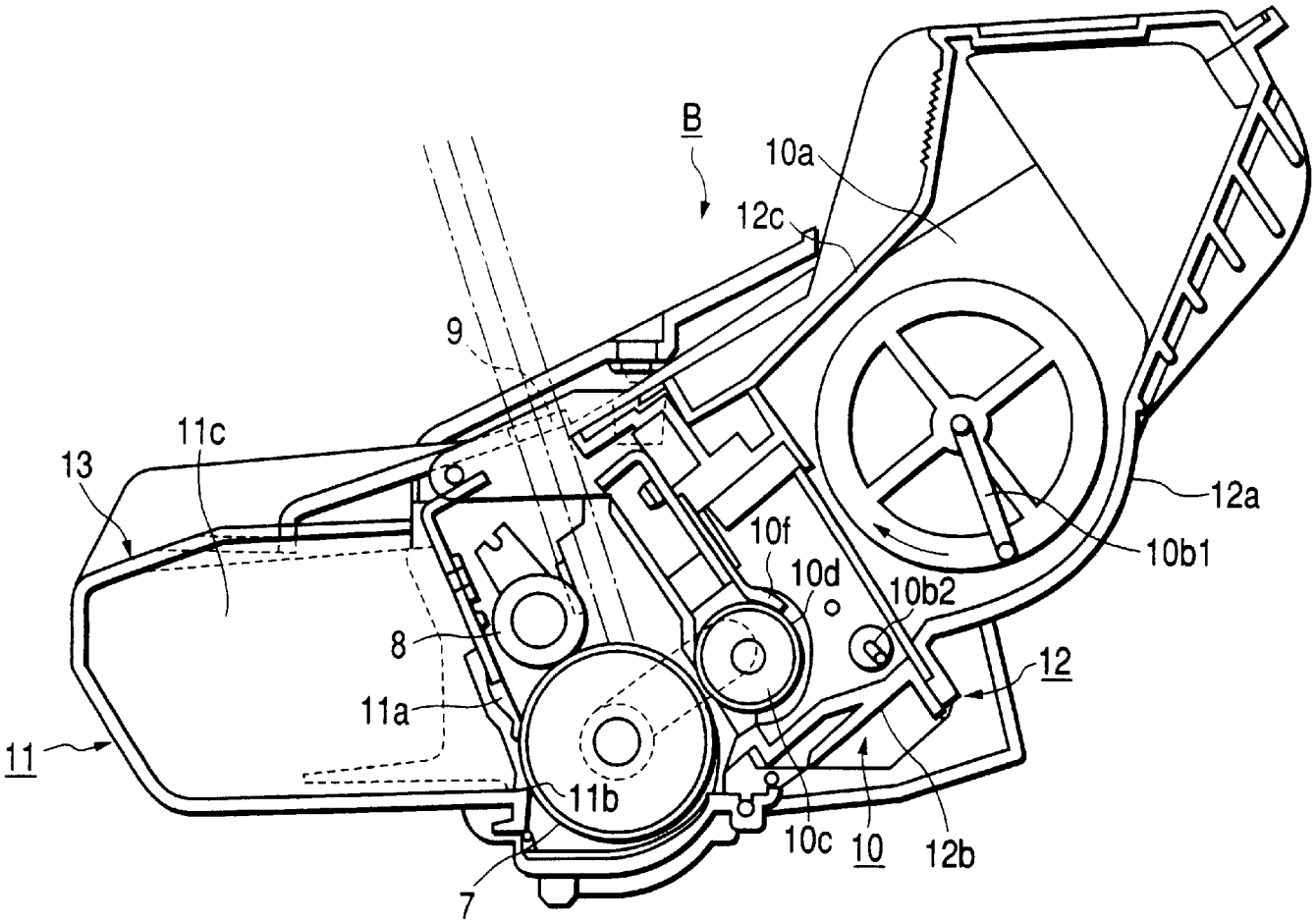
FIG. 7 is a sectional view of the process cartridge according to the present invention.

As shown in FIG. 7, the process cartridge B according to the illustrated embodiment is designed so that the photosensitive drum 7 as an electrophotographic photosensitive member having a photosensitive layer is rotatingly driven, and the surface of the photosensitive drum 7 is uniformly charged by applying voltage to the charging roller 8 as charging means, and the electrostatic latent image is formed by exposing a light image from the optical system 1 on the charged photosensitive drum 7 through an opening portion 9, and the electrostatic latent image is developed as the toner image by the developing apparatus 10.

The developing device 10 serves to feed out the toner in a toner containing portion 10*a* by means of a rotatable first feeding member 10*b*1 and a second feeding member 10*b*2 as feeding means. A developing roller 10*d* as a toner carrying member including a fixed magnet 10*c* therein is rotated, and a triboelectrically charged toner layer is formed on a surface of the developing roller 10*d* by a developing blade 10*f* made of elastic rubber. By applying developing bias, the toner on the developing roller is transferred onto the electrostatic latent image on the photosensitive drum 7, thereby visualizing the electrostatic latent image as the toner image.

After the toner image is transferred to the recording medium 2 by applying, to the transfer roller 4, voltage having polarity opposite to that of the toner image, the toner remaining on the photosensitive drum 7 is scraped off by a cleaning blade 11*a* of the cleaning apparatus 11, and the scraped toner is received by a dipping sheet 11*b* and is collected into a waste toner containing portion 11*c*. In this way, the residual toner on the photosensitive drum 7 is removed.

In the process cartridge B according to the illustrated embodiment, a toner developing frame 12 as a frame of the developing apparatus 10 is formed by integrally welding a developing frame 12*a* having the toner containing portion 10*a* and a developing lower frame 12*b* and a lid member 12*c*, and various members such as the developing roller 10*d* and the developing blade 10*f* are contained within the toner developing frame 12. The process cartridge B is constituted as a cartridge unit by bonding the toner developing frame 12 to a cleaning frame 13 containing various members such as the photosensitive drum 7, charging roller 8 and cleaning apparatus 11, which cartridge unit can detachably be mounted to cartridge mounting means of the main body 14 of the image forming apparatus.

Figure 8:
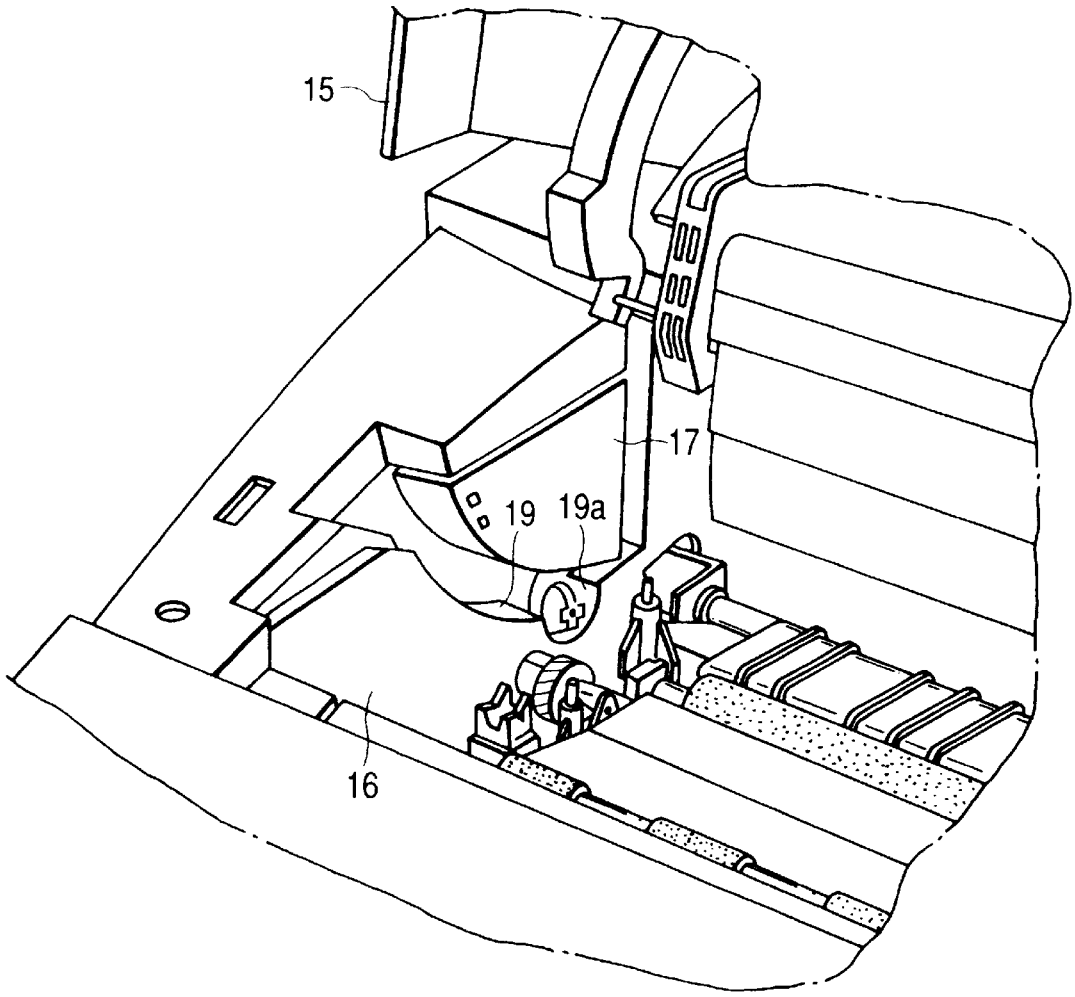
FIG. 8 is a partial perspective view showing a construction of a process cartridge mounting portion of the electrophotographic image forming apparatus having the process cartridge according to the present invention.
Figure 9:
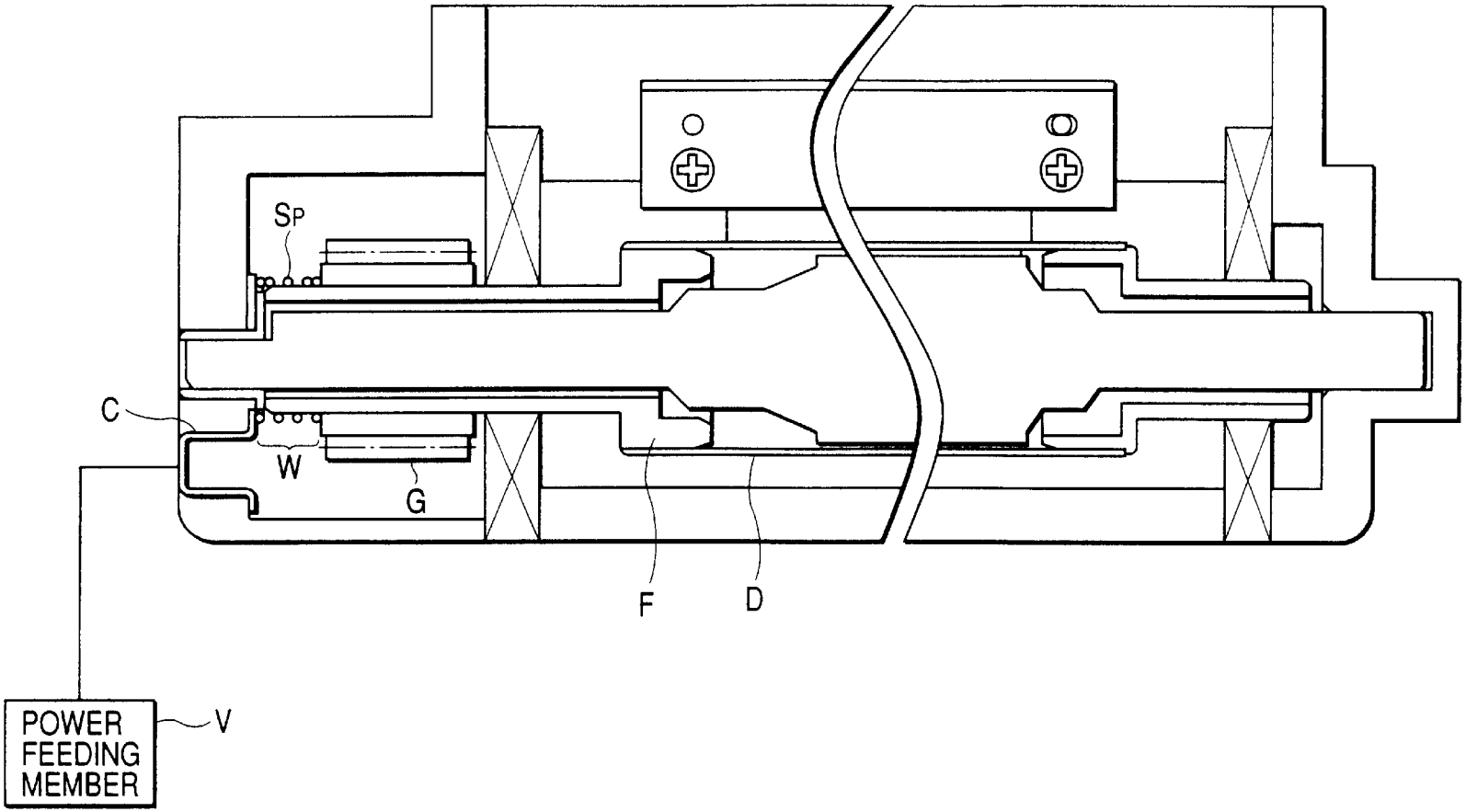
FIG. 9 is a sectional view showing a contact structure of a developing roller.
Figure 10:
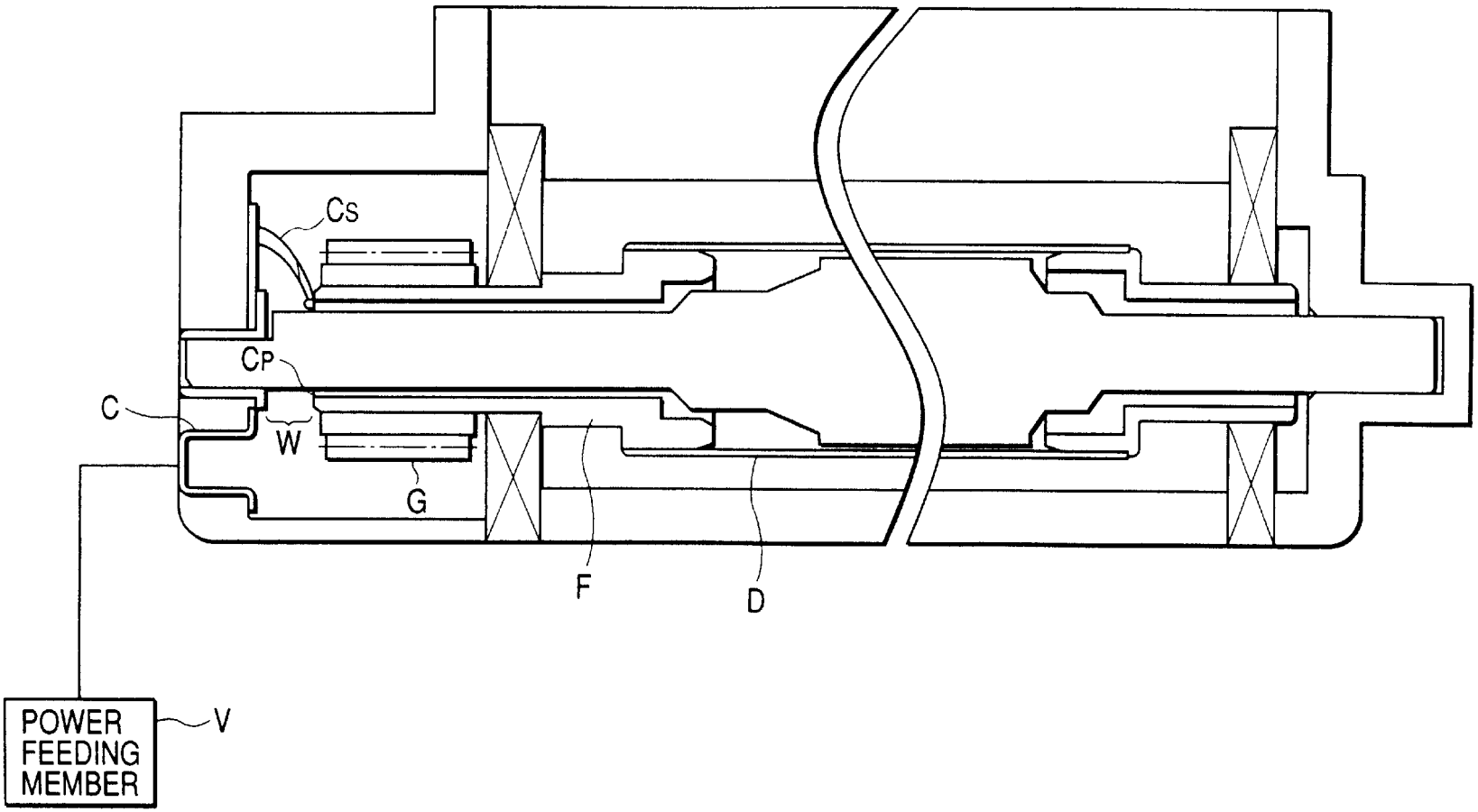
FIG. 10 is a sectional view showing a contact structure of a developing roller.

That is to say, as shown in FIG. 6, the mounting and dismounting of the process cartridge B is performed after an opening/closing member 15 is opened around an axis 15*a*. When the opening/closing member 15 is opened, a cartridge mounting space within the main body 14 of the apparatus is exposed. As shown in FIG. 8, cartridge mounting guide members 17 are formed on both left and right side frames 16 of the cartridge mounting space in an opposed relationship (only one of the guide members is shown in FIG. 8).

On the other hand, bosses (not shown) are formed on both longitudinal outer side surfaces of the process cartridge B. The process cartridge B is inserted by guiding these bosses along guide grooves 19 defied between the left and right guide members 17 and frames 16. Recessed portions 19*a* reformed in terminal ends of the guide grooves 19, and, the process cartridge B is mounted by fitting shaft portions of the bosses into the recessed portions 19*a*. In this case, a drum gear (not shown) provided at one longitudinal end of the photosensitive drum 7 is engaged by a driving gear (not shown) provided in the main body 14 of the apparatus, thereby permitting transmission of a driving force to the photosensitive drum 7.

Figure 2B:
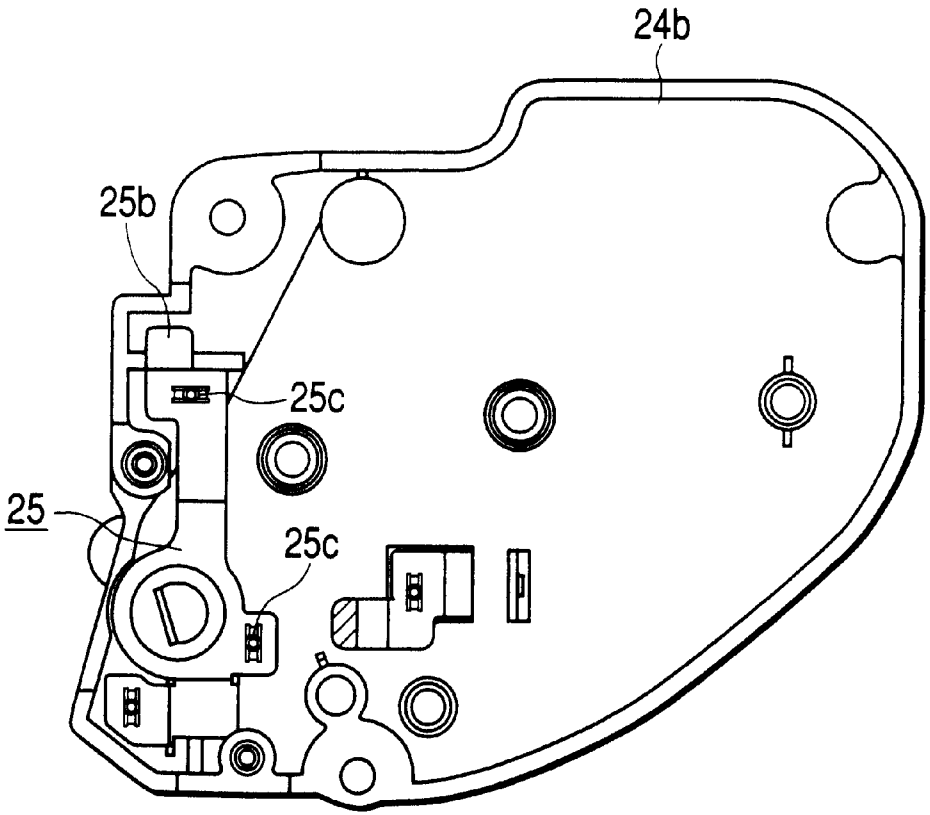
FIGS. 2A and 2B are constructural views of a holder showing a fixed electrode structure of the developing apparatus according to the present invention.
Figure 2A:
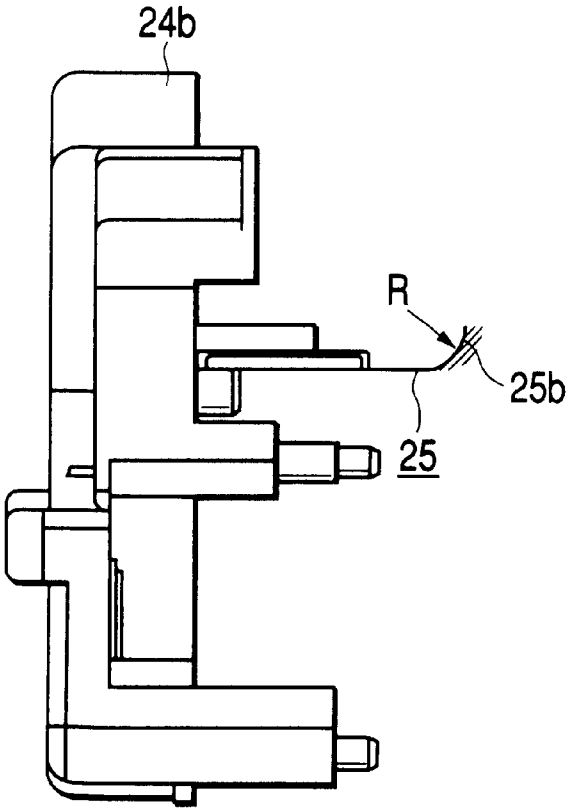
Figure 3:
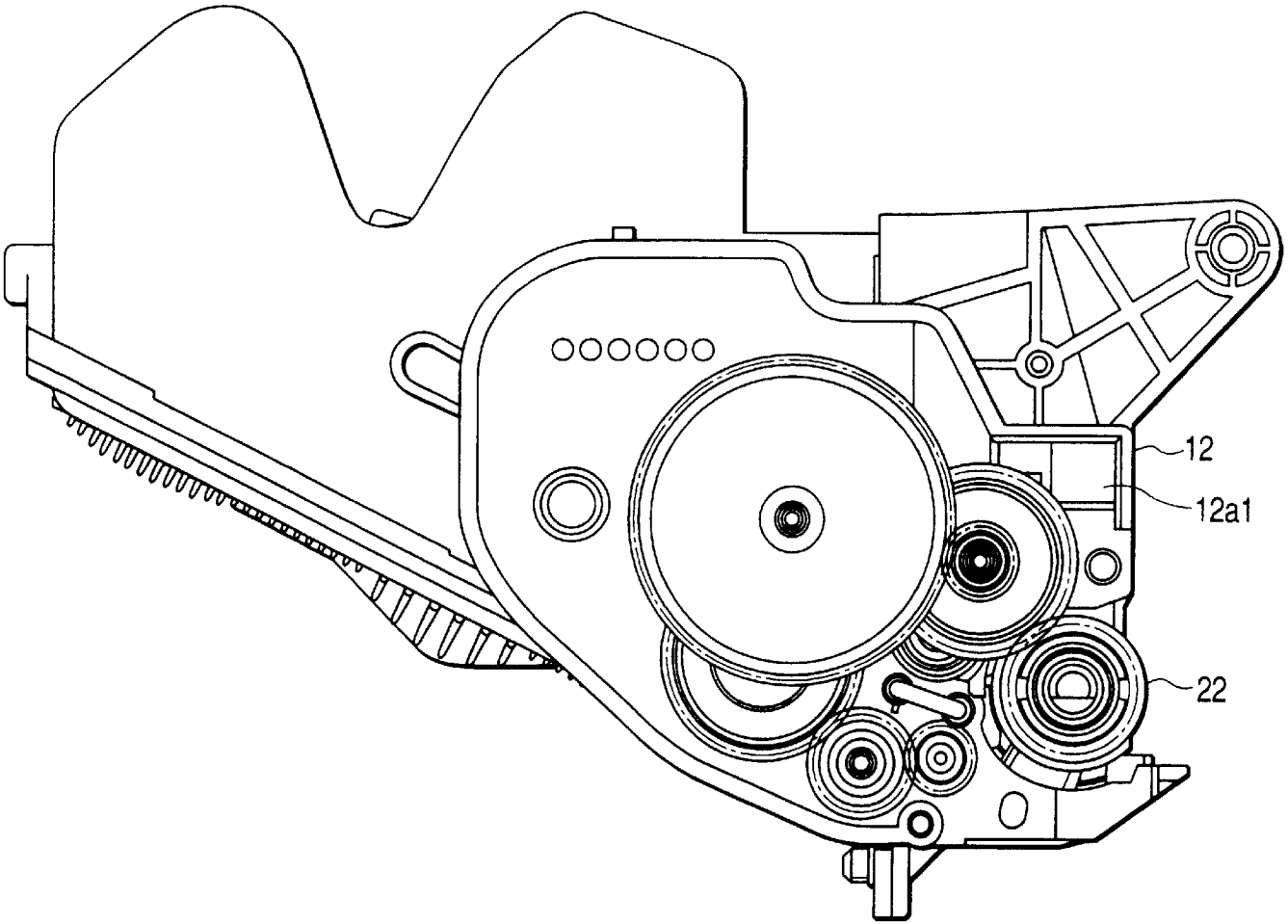
FIG. 3 is a side view of a driving side of a developing frame of the developing apparatus according to the present invention.
Figure 4:
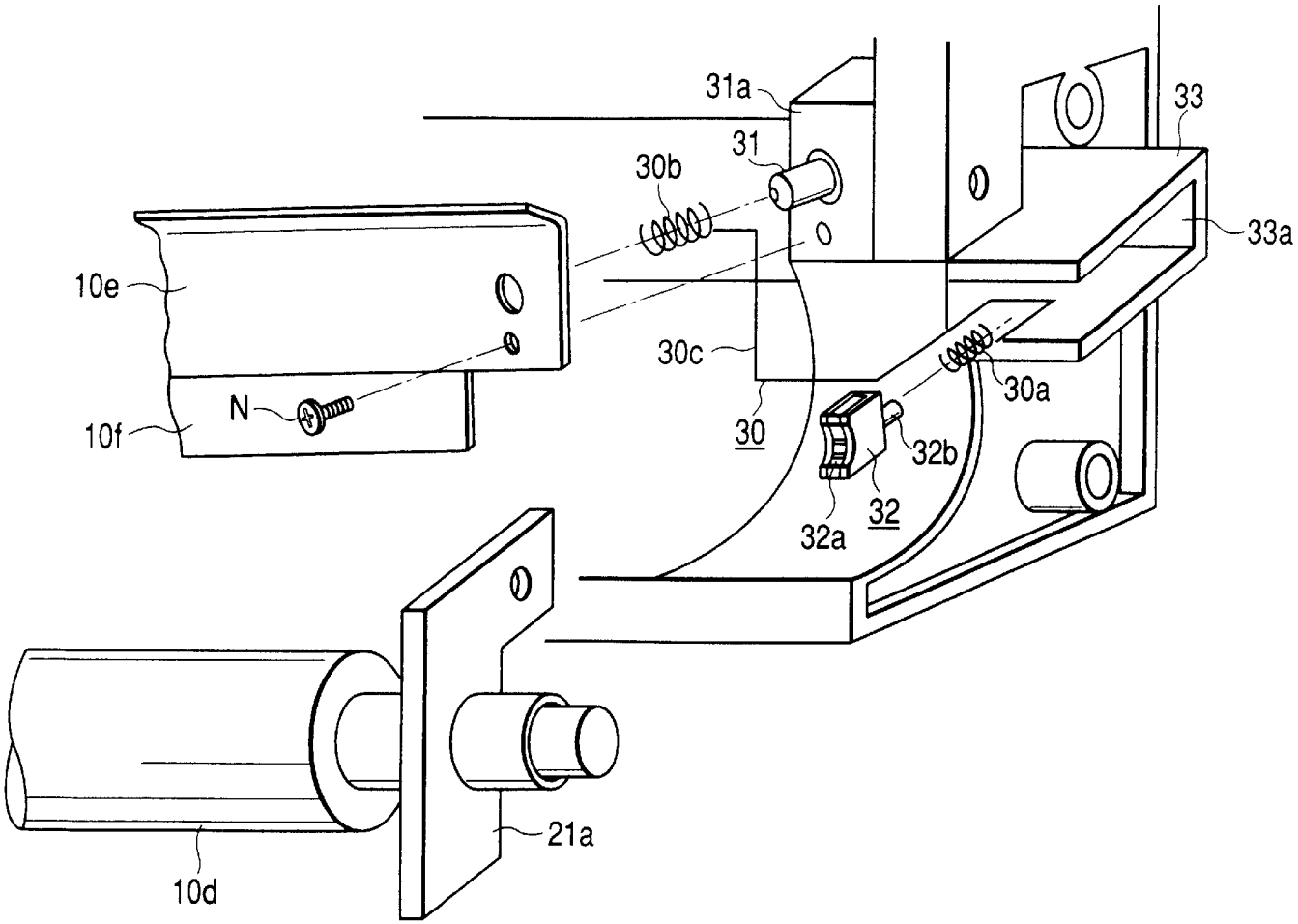
FIG. 4 is an exploded perspective view showing a method for a first electrode of the developing apparatus according to the present invention.
Figure 5:
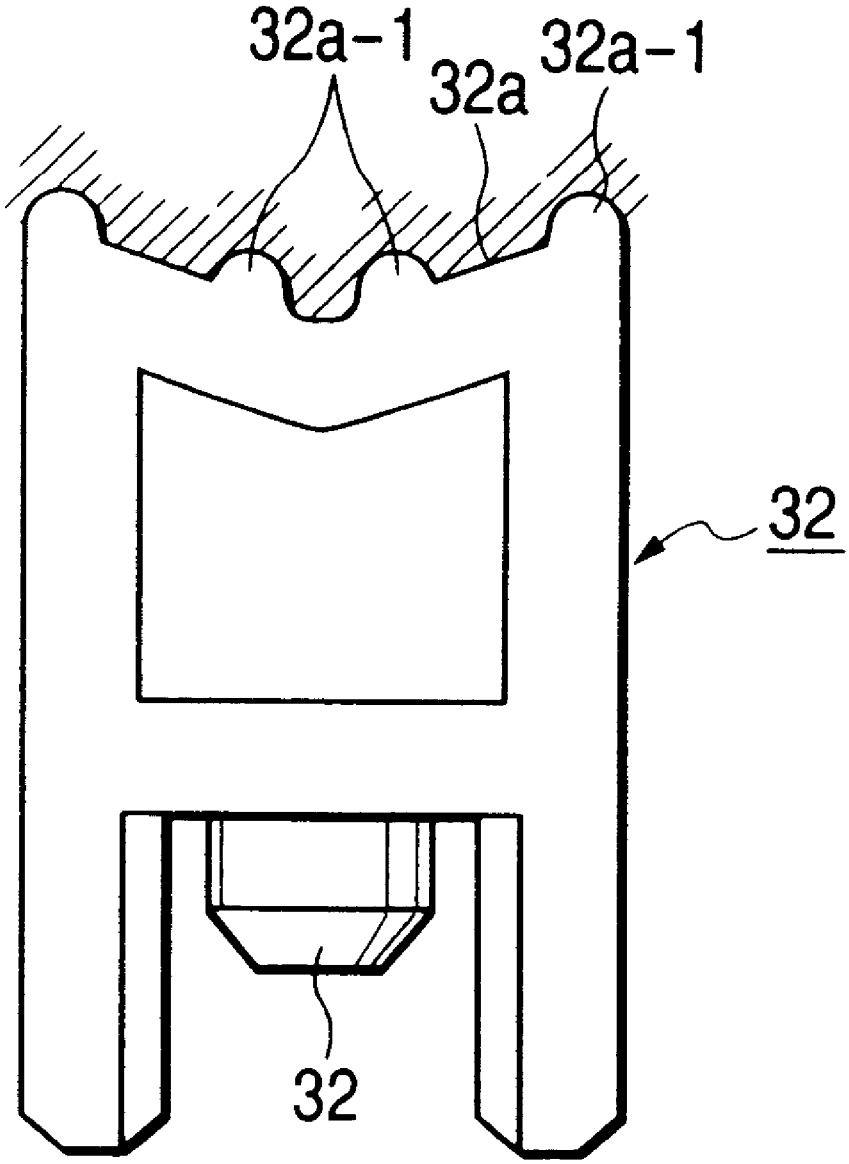
FIG. 5 is a constructural view of a conductive resin member of the developing apparatus according to the present invention.

Next, a contact arrangement for applying the developing bias to the developing roller 10*d* will be explained with reference to FIGS. 1 to 5. Incidentally, FIG. 1 is a sectional view showing a contact structure of the developing roller, FIGS. 2A and 2B are constructural views of a holder showing a fixed electrode structure, FIG. 3 is a side view of a driving side of the developing frame, FIG. 4 is an exploded perspective view showing a method for assembling a first electrode, and FIG. 5 is a constructural view of a conductive resin member.

Figure 1:
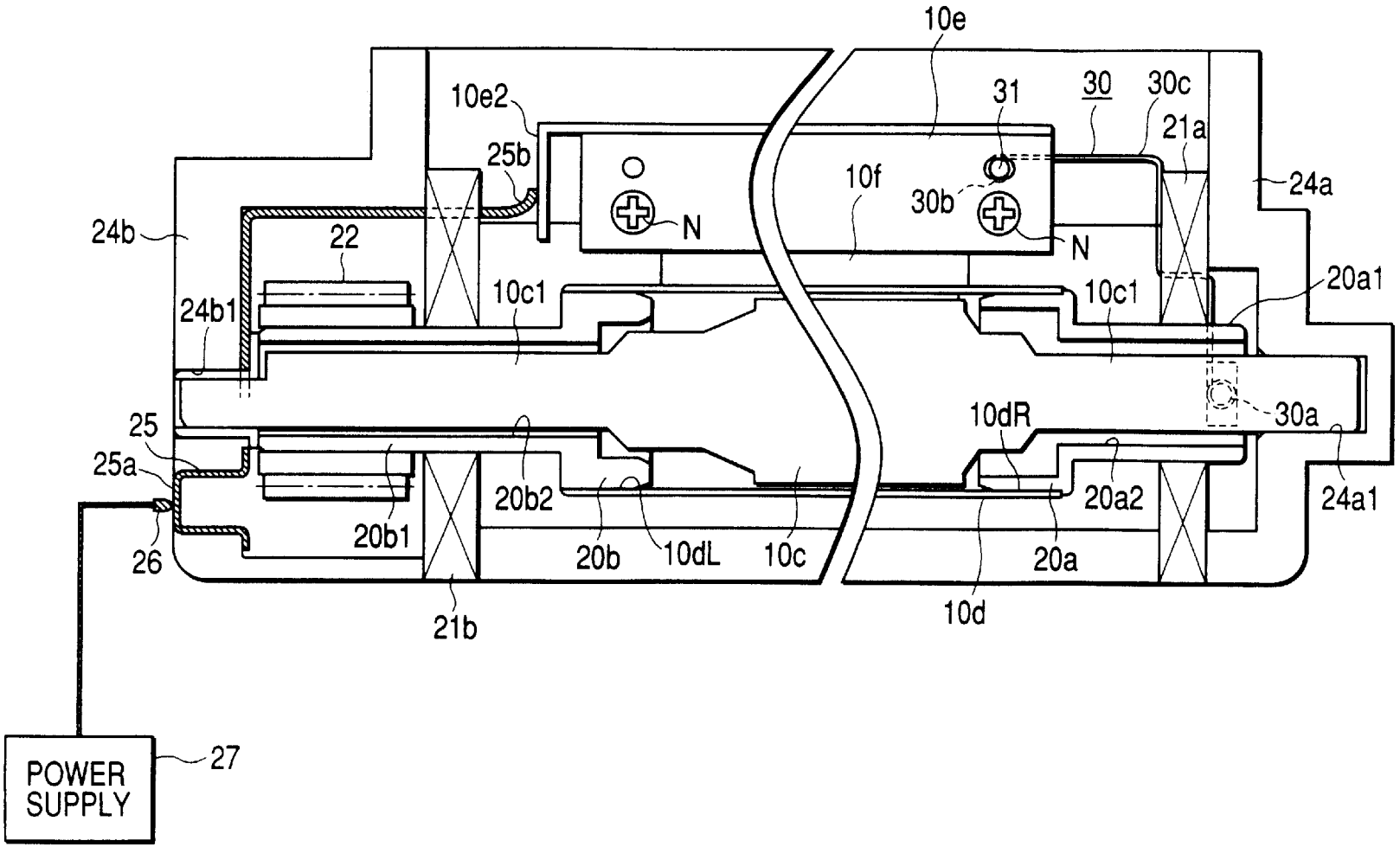
FIG. 1 is a sectional view showing a contact structure of a developing roller of a developing apparatus according to the present invention.

As shown in FIG. 1, the developing roller 10*d* is constituted by a conductive and nonmagnetic cylindrical member made of an aluminium or stainless steel, and flange members 20*a*, 20*b* are fitted into both left and right ends of the developing roller. The right flange member 20*a* made of metal such as aluminium or stainless steel is press-fitted into a right end portion 10*d*R of the developing roller 10*d* and is secured thereto by mechanical means such as caulking, and the flange member 20*a* has a shaft portion 20*a*1 protruding outwardly from the right end portion 10*d*R along a longitudinal direction of the developing roller 10*d*. A circumference of the shaft portion 20*a*1 is rotatably supported by the toner developing frame 12 and a bearing 21*a* secured to a holder 24*a*.

On the other hand, the flange member 20*b* made of metal such as aluminium or stainless steel is press-fitted into a left end portion 10*d*L of the developing roller 10*d* and *i* secured thereto by mechanical means such as caulking, and the flange member 20*b* has a shaft portion 20*b*1 protruding outwardly from the left end portion 10*d*L along the longitudinal direction of the developing roller 10*d*. A circumference of the shaft portion 20*b*1 is rotatably supported by the toner developing frame 12 and a bearing 21*b* secured to a holder 24*b*.

A developing roller gear 22 is secured to the shaft portion 20*b*1 by means such as keys or set screws, so that the driving force is transmitted from the drum gear (not shown) provided on the photosensitive drum 7 to the developing roller gear 22, thereby rotating the developing roller 10*d* at a predetermined rotational speed. In the illustrated embodiment, a side including the developing roller gear 22 is called as a driving side, and the other side is called as a nondriving side.

In the illustrated embodiment, since the shaft portions 20*a*1, 20*b*1 are formed from metal such as aluminium or stainless steel, supporting rigidity for the developing roller 10*d* is enhanced, with the result that rotational accuracy of the developing roller 10*d* can be increased.

Further, the developing roller 10*d* includes therein a magnet roller 10*c* having a plurality of magnetic poles, and the magnet roller 10*c* is provided at its both left and right ends with shaft portions 10*c*1. The left and right shaft portions 10*c*1 extend through central holes 20*a*2, 20*b*2, of the flange members 20*a*, 20*b* and are fixedly supported by support holes 24*a*1, 24*b*1 of the holders 24*a*, 24*b* secured to the toner developing frame 12.

When the process cartridge B incorporating the developing apparatus 10 is mounted to the image forming apparatus A, an exposed portion 25*a* of a fixed electrode member 25 exposed out of the process cartridge B is contacted with an apparatus side contact 26 connected to a power supply 27 of the main body 14 of the apparatus.

The fixed electrode member 25 is constituted by a spring stainless plate or a spring bronze phosphide plate and is secured to the holder 24*b* by bent connections 25*c* or heat caulking (refer to FIGS. 2A and 2B). When the holder 24*b* is assembled to the developing frame 12, a contact portion 25*b* at the other end of the fixed electrode member 25 extends through a hole 12*a*1 (refer to FIG. 3) of the developing frame 12 and is contacted with a driving side surface 10*e*2 (refer to FIG. 1) of a support member 10*e* supporting a developing blade 10*f* made of urethane rubber or the like. Since the contact portion 25*b* of the fixed electrode member 25 is contacted with the driving side side surface 10*e*2 of the developing blade 10*f* with proper contact pressure, a distal end portion of the electrode member acts as a spring portion R.

Further, at a nondriving side of the support member 10*e* of the developing blade 10*f*, there is provided a first electrode 30 (refer to FIGS. 1 and 4) formed from a piano wire, a spring stainless wire or a spring bronze phosphide wire for electrical communication with the shaft portion 20*a*1 of the flange member 20*a*. Further, compression coil spring portions 30*a*, 30*b* having elasticity are provided on both ends of the first electrode 30, and an electrode wire 30*c* connecting between these compression coil spring portions 30*a* and 30*b* is pinched and fixed between the bearing 21*a* and the developing frame 12. Further, the first electrode 30 can be electrically communicated with the support member 10*e* positively by fitting the compression coil spring portion 30*b* onto a positioning boss 31 of the support member 10*e* of the developing frame 12 and by compressing the compression coil spring portion 30*b* between a seat surface 31*a* and the support member 10*e* by tightening the support member 10*e* by means of screws N.

Incidentally, although the compression spring portion 30*a* of the first electrode 30 can be used as a contact by applying conductive grease to a tip end of the compression spring portion 30*a* and by slidingly contacting the compression spring portion 30*a* with the flange member 20*a* directly, in the illustrated embodiment, in order to reduce electrical noise generated at a sliding contact, a conductive resin member 32 is provided between the compression spring portion 30*a* and the shaft portion 20*a*1 of the flange member 20*a*, and the conductive resin member 32 is urged against the shaft portion 20*a*1. As material for the conductive resin member 32 is urged against the shaft portion 20*a*1. As material for the conductive resin member, for example, conductive agent (for example, carbon filler) added PPS (polyphenylene sulphide) or POM (polyacetal) is used.

Electrical communication is permitted by fitting and securing a shaft 32*b* of the conductive resin member 32 in and to the compression coil spring portion 30*a*. Further, as shown in FIG. 5, a plurality of projections 32*a*-1 are formed on a sliding surface 32*a* of the conductive resin member 32 contacted with the shaft portion 20*a*1 of the flange member 20*a*. During the injection molding, since conductive material tends to concentrate onto the projections 32*a*-1to expose the conductive material outside, good conductivity can be obtained at the contact portions. In order to realize low noise, low wear and good conductivity between the conductive resin member 32 and the shaft portion 20*a*1 of the flange member 20*a*, it is desirable to select spring pressure of the compression coil spring portion 30*a* to 100 to 200 gf (0.98 to 1.96 N). Further, in the illustrated embodiment, while an example that four projections 32*a*-1 having "R" tip ends are formed on the sliding surface 32*a* of the conductive resin member 32 was illustrated, the number of the projections 32*a*-1 is not limited to four.

The conductive resin member 32 attached to the compression coil spring member 30*a* is held by a guide 33 (refer to FIG. 4) integrally formed with a side surface of the developing frame 12 and abutment is effected from a radial direction of the shaft portion 20*a*1 of the flange member 20*a*. In consideration of assembling convenience of the first electrode 30, the guide 33 is formed to be substantially perpendicular to the seat surface 31*a* of the support member 10*e* of the developing blade 10*f*.

When the holder 24*a* is assembled to the developing frame 12, an open surface 33*a* of the guide 33 is closed by an inner wall of the holder 24*a*, the conductive resin member 32 is prevented from being disengaged from the guide 33.

With the arrangement as mentioned above, when the process cartridge B is mounted to the image forming apparatus A, the apparatus side contact 26 connected to the power supply 27 is contacted with the exposed portion 25*a* of the fixed electrode member 25, with the result that the bias is applied to the developing roller 10*d* from the contact portion 25*b* of the fixed electrode member 25 through the driving side side surface 10*e*2 of the support member 10*e* of the developing blade 10*f*, the support member 10*e*, the compression coil spring portion 30*b*, electrode wire 30*c* and compression coil spring portion 30*a* of the first electrode 30 at the non-driving side of the support member 10*e*, the conductive resin member 32, and the shaft portion 20*a*1 of the flange member 20*a*.

Next, an assembling procedure of the contact portion of the developing roller 10*d* will be described.

First of all, the shaft portion 32*b* of the conductive resin member 32 is fitted into the compression coil spring portion 30*a* of the first electrode 30. Then, the compression coil spring portion 30*a* and the conductive resin member 32 are inserted along the guide 33 of the developing frame 12. Further, the compression coil spring portion 30*b* is fitted onto the positioning boss 31 of the support member 10*e* of the developing frame 12.

Then, the support member 10*e* is secured to the developing frame 12 by the screws N. In this case, by compressing and fixing the compression coil spring portion 30*b* between the support member 10*e* and the seat surface 31*a*, positive electrical communication with the support member 10*e* can be achieved. Further, since the direction of the guide 33 is substantially perpendicular to the seat surface 31*a*, the assembling of the compression coil spring portions 30*a* and 30*b* of the first electrode 30 can be facilitated.

Then, after the magnet roller 10*c* is inserted into the developing roller 10*d*, the flange members 20*a*, 20*b* are secured to both ends of the developing roller 10*d*, and the bearings 21*a*, 21*b* are fitted onto the shaft portions 20*a*1, 20*b*1 of the flange members 20*a*, 20*b*, and the developing roller gear 22 is assembled to the driving side shaft portion 20*b*1. Then, when the bearings 21*a*, 21*b* are secured to the developing frame 12 by the holders 24*a*, 24*b*, the conductive resin member 32 abuts against the shaft portion 20*a*1 of the flange member 20*a* from the radial direction of the shaft portion 20*a*1. Incidentally, the fixed electrode member 25 is previously secured to the holder 24*b* by the bending connections 25*c* or heat caulking.

When the holder 24*b* is assembled to the developing frame 12, the contact portion 25*b* of the fixed electrode member 25 extends through the hole 12*a*1 (refer to FIG. 3) of the developing frame 12 and is contacted with the driving side surface 10*e*2 of the support member 10*e*. As a result, when the process cartridge B is mounted to the image forming apparatus A, the exposed portion 25*a* of the fixed electrode member 25 is contacted with the apparatus side contact 26 connected to the power supply 27, thereby establishing a power feeding path in which the bias is applied to the developing roller 10*d* from the contact portion 25*b* of the fixed electrode member 25 through the driving side side surface 10*e*2 of the support member 10*e* of the developing blade 10*f*, the support member 10*e*, the compression coil spring portion 30*b*, electrode wire 30*c* and compression coil spring portion 30*a* of the first electrode 30 at the nondriving side of the support member 10*e*, the conductive resin member 32, and the shaft portion 20*a*1 of the flange member 20*a*.

With the arrangement as mentioned above, since a space W for a driving side coil spring Sp and an elastic abutment portion Cs can be omitted, the developing apparatus 10 and the process cartridge B can be made more compact.

While the embodiment of the present invention was explained, the present invention is not limited to such an embodiment, but, various alternations and modifications can be made within the scope of the invention.

What is claimed is:

1. A developing device detachably mountable to an image forming apparatus, comprising:

a developer carrying member for carrying developer;

a developer regulating member for regulating an amount of the developer on said developer carrying member;

a conductive support member for supporting said developer regulating member;

a driving gear provided on said developer carrying member and adapted to receive a driving force from a main body of said image forming apparatus;

a first electrode member which is provided at a driving side of said developer carrying member and to which developing voltage is applied, wherein said first electrode member is electrically communicated with said conductive support member; and a second electrode member for electrically communicating between said conductive support member and a nondriving side of said developer carrying member.

2. A developing device according to claim 1, wherein, when said developing device is mounted to a predetermined position of said image forming apparatus, said first electrode member is contacted with a contact portion of said main body of said image forming apparatus.

3. A developing device according to claim 1, wherein said developer carrying member includes a developing roller and a conductive flange member secured to an end of said developing roller, and said second electrode member is contacted with said conductive flange member.

4. A developing device according to claim 3, wherein said second electrode member includes a conductive resin close contacting with said conductive flange member, and a coil spring fitted onto said conductive resin and for urging said conductive member against said conductive flange member.

5. A developing device according to claim 1, wherein said developer regulating member includes a rubber blade.

6. A developing device according to claim 1, wherein said developing device is constituted as a process cartridge integrally including at least a photosensitive member.

* * * * *

UNITED STATES PATENT AND TRADEMARK OFFICE

CERTIFICATE OF CORRECTION

PATENT NO. : 6,385,413 B2
DATED : May 7, 2002
INVENTOR(S) : Teruhiko Sasaki et al.

It is certified that error appears in the above-identified patent and that said Letters Patent is hereby corrected as shown below:

Column 1,
Line 21, “a,” should read -- a --.

Column 4,
Line 17, “defied” should read -- defined --;
Line 40, “an” should be deleted; and
Line 54, “i” should read -- is --.

Column 5,
Line 2, “as” (both occurrences) should be deleted; and
Line 11, “its both” should read -- both its --.

Signed and Sealed this

Eighth Day of October, 2002

*Attest:*

*Attesting Officer*

JAMES E. ROGAN
*Director of the United States Patent and Trademark Office*